US011534784B2

(12) United States Patent
Knight

(10) Patent No.: US 11,534,784 B2
(45) Date of Patent: Dec. 27, 2022

(54) DISPENSER PUMP

(71) Applicant: RIEKE PACKAGING SYSTEMS LIMITED, Leicester (GB)

(72) Inventor: Simon Christopher Knight, Bridgend Mid Glamorgan (GB)

(73) Assignee: RIEKE PACKAGING SYSTEMS LIMITED

( * ) Notice: Subject to any disclaimer, the term of this patent is extended or adjusted under 35 U.S.C. 154(b) by 0 days.

(21) Appl. No.: 17/328,177

(22) Filed: May 24, 2021

(65) Prior Publication Data

US 2021/0346899 A1 Nov. 11, 2021

Related U.S. Application Data

(63) Continuation of application No. 15/770,774, filed as application No. PCT/GB2016/053331 on Oct. 26, 2016, now Pat. No. 11,014,108.

(30) Foreign Application Priority Data

Oct. 26, 2015 (GB) ..... 1518910

(51) Int. Cl.
*B05B 11/00* (2006.01)

(52) U.S. Cl.
CPC ..... *B05B 11/0029* (2013.01); *B05B 11/0032* (2013.01); *B05B 11/0044* (2018.08);
(Continued)

(58) Field of Classification Search
CPC ..... B05B 11/3032; B05B 11/3033; B05B 11/007; B05B 11/00412; B05B 11/00416;
(Continued)

(56) References Cited

U.S. PATENT DOCUMENTS 3,680,986 A * 8/1972 Kutik ..... B05B 11/3066 417/520
3,726,442 A * 4/1973 Davidson ..... B05B 11/0044 222/207

(Continued)

FOREIGN PATENT DOCUMENTS

FR 2969241 4/2014
KR 102174715 10/2020

(Continued)

*Primary Examiner* — Charles P. Cheyney
(74) *Attorney, Agent, or Firm* — McDonald Hopkins LLC

(57) ABSTRACT

A dispenser pump is constituted by a closure body (2), a diaphragm body (3) which forms a pump chamber with the closure body and optionally a top actuator (4) for pressing the diaphragm body (4). The diaphragm body has a deformable wall (35) formed integrally in the same polymer as its annular mounting portion (31). An inlet valve (5) through the floor (21) of the closure body has a flap (52) which is formed and hinged integrally with that floor (21). An outlet valve may also be formed in the same polymer, either integrally with the diaphragm body or as a separate component. The deformable wall of the diaphragm body is shaped to generate a restoring force itself without a separate spring, so that the entire pump may be made from the same polymer e.g. polypropylene and without metal components.

7 Claims, 8 Drawing Sheets

(52) U.S. Cl.
CPC ..... *B05B 11/3032* (2013.01); *B05B 11/3033* (2013.01); *B05B 11/3069* (2013.01); *B05B 11/007* (2013.01); *B05B 11/3047* (2013.01)

(58) Field of Classification Search
CPC ..... B05B 11/3028; B05B 11/0029; B05B 11/0044; B05B 11/0032; B05B 11/3047
USPC ..... 222/321.7, 207, 209, 494, 153.13
See application file for complete search history.

(56) References Cited

U.S. PATENT DOCUMENTS

| | | | | |
|---|---|---|---|---|
| 3,820,689 | A * | 6/1974 | Cocita | G01F 11/08 222/207 |
| 4,867,347 | A * | 9/1989 | Wass | B05B 11/3032 222/153.13 |
| 5,099,885 | A * | 3/1992 | Nilsson | B05B 11/3032 137/852 |
| 5,819,990 | A | 10/1998 | Cimentepe | |
| 5,924,603 | A | 7/1999 | Santagiuliana | |
| 6,068,250 | A | 5/2000 | Hawkins | |
| 6,113,082 | A | 9/2000 | Fujino | |
| 6,223,954 | B1 | 5/2001 | Carow | |
| 6,789,354 | B2 * | 9/2004 | Wells | A01G 7/06 222/209 |
| 6,983,924 | B2 | 1/2006 | Howell | |
| 8,960,507 | B2 | 2/2015 | Sciole | |
| 10,252,841 | B2 | 4/2019 | Knight | |
| 10,335,815 | B2 * | 7/2019 | Bruder | A45D 34/00 |
| 10,350,620 | B2 | 7/2019 | Knight | |
| 10,661,292 | B2 * | 5/2020 | Santagiuliana | B05B 11/0037 |
| 10,717,565 | B2 | 7/2020 | Knight | |
| 10,723,528 | B2 | 7/2020 | Knight | |
| 10,741,740 | B2 | 8/2020 | Dubois | |
| 10,773,269 | B2 | 9/2020 | Dejong | |
| 2005/0024100 | A1 | 2/2005 | Date | |
| 2005/0241000 | A1 | 10/2005 | Kawauchi | |
| 2005/0241001 | A1 | 10/2005 | Parry | |
| 2005/0241002 | A1 | 10/2005 | Ueda | |
| 2005/0241003 | A1 | 10/2005 | Sweeney | |
| 2005/0241004 | A1 | 10/2005 | Pyhalammi | |
| 2005/0241005 | A1 | 10/2005 | Kunemund | |
| 2005/0241006 | A1 | 10/2005 | Kucherlapati | |
| 2005/0241007 | A1 | 10/2005 | Miskey | |
| 2005/0241008 | A1 | 10/2005 | Bredesen | |
| 2005/0241009 | A1 | 10/2005 | Potash | |
| 2006/0115213 | A1 | 6/2006 | Maeda | |
| 2009/0102106 | A1 | 4/2009 | Ohashi | |
| 2009/0302064 | A1 * | 12/2009 | Lavabre | B05B 11/00442 222/207 |
| 2012/0325861 | A1 | 12/2012 | Pardonge | |
| 2014/0252033 | A1 * | 9/2014 | Murray | B05B 11/3033 222/107 |
| 2015/0090741 | A1 | 4/2015 | Laffey | |
| 2017/0157631 | A1 | 6/2017 | Kraus | |
| 2019/0368567 | A1 | 12/2019 | Deman | |
| 2020/0032870 | A1 | 1/2020 | Deman | |

FOREIGN PATENT DOCUMENTS

| | | |
|---|---|---|
| WO | 1994020221 | 9/1994 |
| WO | 2001087494 | 11/2001 |
| WO | 2018126397 | 7/2018 |
| WO | 2020156935 | 8/2020 |

* cited by examiner

DISPENSER PUMP

CROSS REFERENCE TO RELATED APPLICATION

This application is a continuation of U.S. patent application Ser. No. 15/770,774 filed on Apr. 25, 2018 (now U.S. Pat. No. 11,014,108) which is, itself, a 35 U.S.C. 371 national stage filing of PCT Application No. PCT/GB2016/053331 filed on Oct. 26, 2016, entitled "DISPENSER PUMP," which claims priority to European Patent Application No. 1518910.3, filed on Oct. 26, 2015, each of which are incorporated herein in their entirety by reference.

This invention has to do with dispensers which dispense flowable products, such as liquids, creams and gels, from containers. It has particular relevance for dispensers for products for household cleaning, washing, toiletries, bathroom, cosmetic or medical use where it is desirable to dispense small amounts or doses of product by a simple hand action. One particular aim addressed is to provide a product which is economical to make and allows for convenient recycling.

BACKGROUND

The simplest mass-produced dispensers have a moulded plastics closure snapped or screwed onto the neck of a plastics bottle, defining an outlet opening through which product can be squeezed or poured. A cap or plug for the opening may be formed in one piece with the closure. Also widely used are pump dispensers, in which the user depresses a head or plunger to pump product out of a discharge nozzle or external discharge opening via a pump chamber of variable volume, usually with a piston/cylinder action, by means of inlet and outlet valves. Pump dispensers are more complex and expensive, and less susceptible to recycling because materials including metals and non-degradable plastics are often used for springs, valve elements and so forth. It is known to use a resilient pump chamber wall (bellows) to avoid using a discrete spring, but still much is left to be desired in terms of economy, simplicity and recyclability combined with effective operation.

THE INVENTION

In this application we propose dispensers of the pump type in which a dispensing pump is mounted on a container, typically on a neck of the container. The pump has an inlet to receive product from the container, a pump chamber of variable volume, an outlet from the pump chamber leading to an outlet passage and external discharge opening, and inlet and outlet valves to assure correct directional flow. An actuator, such as a push button or plunger head, may be provided for changing the pump chamber volume in a dispensing stroke.

Proposals herein are particularly directed to enabling manufacture with a small number of components and avoiding the use of non-polymeric materials and particularly non-recyclable materials. In preferred embodiments the pump is made entirely from one polymer type, preferably thermoplastics such as polypropylene.

We put forward the following proposals for the structure of a dispenser pump. It will be understood that they are generally combinable and it is preferred to combine them insofar as they are compatible. General aspects are also put forward in the claims, and these again are generally disclosed for combination with any of the specific proposals below.

(1) General Component Disposition

The pump comprises first and second pump body components opposed and joined together to define a pump chamber between them. At least one of the components comprises a deformable wall which can be deformed to change the volume of the pump chamber in the dispensing stroke. Preferably the first component is a fixed closure or pump body which includes retaining formations for engaging the container neck and also defines an inlet, but does not deform, while the second component is a diaphragm component including the deformable wall. An actuator component may also be provided to assist and/or guide manual movement of the deformable wall. Such an actuator component can also cover or protect the deformable wall. Usually it will be discrete from the diaphragm body for ease of moulding, although in some cases it might be integrated with the closure body or diaphragm body, or might be unnecessary.

Preferably the deformable wall is resiliently deformable, generating its own restoring force to return to the start position (extended position) and re-fill the pump chamber after each stroke, desirably without any additional restoring spring. It is strongly preferred to avoid the use of elastomer materials, especially thermosetting materials which are generally expensive and non-degradable. Accordingly, the preferred deformable wall is given a geometrical form so as to generate restoring force on deformation in the dispensing stroke, even when thermoplastic and especially non-elastomeric material is used. Preferably the deformable wall has one or more bendable facets, each facet meeting a relatively rigid interrupter formation along a boundary which is convex into the facet, so that on depressing the wall (to reduce the pump chamber volume) the more rigid interrupter portion forces bending of the facet to conform to the convex boundary and generate substantial restoring force. Desirably there are plural facets, each with its interrupter portion, and these may be distributed around a central axis e.g. in a pyramid form. The interrupter forms may be cylindrical surface portions angled down into the facets. By localising the bending, sufficient restoring force can be achieved to obviate a separate spring.

A further feature of our proposals is that one or both of the inlet valve and outlet valve have a respective movable valve element, such as a flap, formed integrally with the first and/or second pump body component. For example the first component/closure body may define an inlet opening. An inlet valve flap, formed integrally with the first component/closure body or with the second component/diaphragm body, overlies the inlet opening on the pump chamber side. Specific inlet valve constructions are proposed below.

The outlet opening or discharge passage may be defined by, through or between the first component and/or the second component, preferably through a closure body component (fixed first component). An outlet valve function may be provided by an outlet valve flap formed integrally with one of the body components, preferably a diaphragm body component, and extending into or across the outlet opening e.g. from an attached end (root) to a free end, so that it tends to deform and open the discharge channel under forward pressure, while tending to close the discharge channel/outlet opening under reverse pressure. Alternatively a valve flap may be formed as part of a discrete valve element, but desirably of the same polymer type (e.g. polypropylene) as an adjacent first/second body component to which it connects.

In a preferred format of the dispenser the closure body includes a closure plate or floor plate through which the inlet opening is defined, and having an annular retaining formation at a top surface. The diaphragm body has an annular support or mounting portion which engages the retaining formation of the closure body to define the pump chamber, with the deformable wall of the diaphragm body spaced above the floor plate of the closure body. The deformable wall may have a central hub portion, typically non-deformable, where it may be engaged by an actuator portion, or this portion may itself constitute an actuator portion such as a button. The inlet opening may open at a peripheral (non-central) position. An inlet valve flap, desirably integrally formed with or hinged to either the closure body or the diaphragm body, overlies the inlet opening. The closure body may comprise a retainer (socket or spigot) for a dip tube extending below the inlet opening.

In a preferred format the deformable wall comprises plural bendable facets distributed around the central hub of the diaphragm body. An outlet opening or discharge channel is defined at the edge or circumference of the arrangement, with an external opening being desirably through the closure body. An outlet valve may be provided by a movable portion such as a flap, desirably integrally joined or hinged to one of the bodies, preferably integral with the annular support portion of the diaphragm body. Or, it may be provided as part of a discrete valve element secured to one of the mentioned parts. A seat against which the flap rests in the closed position may be on the same body e.g. diaphragm body, or as part of the other body. The closure body may comprise an upward guide formation or surround which encloses the diaphragm body and/or guides the movement of an actuator component such as a sliding push button connected to the hub of the diaphragm body.

The floor or closure plate may have a central depression formation to accommodate the stroke of the central hub of the diaphragm body.

With this general construction, an operational pump can be achieved with as few as three or even two moulded components, which may be of economical and recyclable thermoplastics such as polypropylene. If desired a further component (actuator) completes a user-friendly package.

(2) Inlet Valve Proposals

In one preferred version, an inlet valve flap is formed integrally with the floor of the closure body (or first pump body component) adjacent the inlet opening. Moulding this can be by moulding the flap portion projecting straight up from the base or floor of the closure body adjacent the inlet opening, and then folding it to overlie the inlet opening as part of the assembly process. In a preferred version the folded-down flap portion is itself overlapped from above by a portion of one of the body components in the assembled condition, restricting its movement back up away from the inlet opening. For example, the first component/closure portion may comprise an integral upward projection with a downward shoulder, face or overhang, next to the flap position, and the flap is pushed past this during assembly to be trapped subsequently. This may be a snap engagement, pushing the flap past resilient deformation of the retaining projection, desirably with a retaining shoulder to fix its position thereafter. There may be such a retaining projection to either side of the flap, for more secure retention. This is believed to be a novel one-piece valve formation and is an independent proposal herein for both the structure and the method of moulding/assembling.

Preferably the inlet opening enters the pump chamber through a surface of the first component which is generally perpendicular to an axis of the pump, such as the axis of movement of the deformable wall. This surface can provide a flat seating surface against which the inlet valve flap acts.

A preferred option in this proposal is for a valve seat surrounding the inlet, against which the flap engages to close the inlet, to be formed and positioned relative to the retaining projection(s) such that the flap is urged with pre-tension against the valve seat.

In another inlet valve embodiment, an integral formation or flap of the second component/diaphragm body projects across the inlet opening of the first component/closure body to constitute the inlet valve member or valve flap. This may be an inward projection from an annular support portion of a diaphragm body as described above.

(3) Outlet Valve Proposals

It is preferred that a movable valve member or valve flap for the outlet valve is formed integrally with one of the first and second pump body components, preferably with a diaphragm body component, especially at a periphery thereof adjacent a peripheral discharge channel/discharge opening of the pump. In one embodiment the flap projects outwardly (i.e. in the direction of outflow, e.g. radially) into the outlet, being inclined so as to be forced open by outward pressure and forced closed by inward pressure, e.g. by axial or circumferential bending. Thus, the attachment of the flap is upstream of the free end. In another embodiment the flap may cross the opening, e.g. in a circumferential direction of an annular pump structure, so that the flap movement is by bending at a hinge which is to one circumferential side of the opening, e.g. by radially outward bending.

A particular proposal here is for an outlet valve which can be held or locked shut when desired. The flap is provided as a circumferentially-extending portion of an annular support formation of one of the first and second body components. It projects circumferentially across an opening or gate constituting or leading into the discharge channel. Preferably it is part of a diaphragm body component. The other body component has an adjacent restraining formation, which may be part of an annular retaining formation which holds the body components together. The components are relatively rotatable between an open or unlocked condition, in which the valve flap can flex into a clearance of the discharge channel to allow product out, and a closed or locked condition in which the restraining formation of the other component prevents the flap from making the opening movement. The restraining portion may be part of an annular wall, and the valve flap or a part of it may slide behind this wall when the components are rotated.

In this proposal the actuator may be rotationally locked to the diaphragm body and have a grip formation for manual turning, so that the outlet valve can be locked or unlocked by turning the actuator.

A similar action and elements may be provided if the outlet valve is provided as a discrete element, e.g. attached to the diaphragm body mounting portion.

A further proposal for an outlet valve is for the first and second body components to have engaging portions, such as at interengaging annular retaining formations which hold these body components together, which have respective openings defining respective portions of the outlet path, and which are brought into line—thereby opening the outlet path—when the pump is operated such as by pressing the deformable wall. This may be by a relative axial or up/down sliding of the two components, such as in the direction of depression/actuation of the dispenser. One or both components may comprise one more resiliently flexible return spring components or portions, desirably integrally formed, engaging the other component so as to bias them towards the closed position of the outlet path, e.g. an upward axial bias of the diaphragm body away from the closure body.

(4) Proposals for Venting

The described dispenser pumps may be used on any kind of container, including "airless" containers where (by means of a follower piston, collapsible container or container lining) the container volume decreases as the product is progressively dispensed. However, the simplest and most economical products use non-collapsible containers for which it is necessary to allow venting, i.e. limited admission of air into the container to compensate for the volume of product dispensed.

In embodiments where a diaphragm body is fastened down onto a closure body, the closure body may have one or more vent openings communicating through its base or floor plate. The diaphragm body is connected to the closure body by a support portion, e.g. annular, formed integrally with the deformable wall of the diaphragm body and connecting to the closure body adjacent a said vent opening of the closure body. The closure body has a retaining formation, such as an annular or part-annular projection, which seals against the support portion of the diaphragm body when the pump is in the rest (extended) position, isolating the vent opening(s) from the exterior outside the diaphragm body. However when the deformable wall is operated in a dispensing stroke (typically by depressing its centre) the support portion of the diaphragm body is movable and/or deformable such that it moves or tilts away from the sealing contact with the closure body formation, allowing venting air to enter between them and reach the vent opening to the container interior. There may be more than one vent opening distributed around the support wall of the diaphragm body. The support portion may be in the form of a wall standing generally upright from the floor plate, the retaining formation of the closure body being a surround wall next to it; typically both are annular.

The outer surface of the diaphragm body support portion may be formed with a projecting lip to engage the formation of the closure body at this position, to enhance sealing (closure of the vent) when they are urged together under (usually) low force in the rest position.

In embodiments where the support portion of the diaphragm body is slidable relative to the closure body, in the direction of actuation of the dispenser (axial, or up/down direction) this movement may close and open the vent opening(s).

Examples of our proposals are now described with reference to the accompanying drawings, in which:

FIGS. 1 and 2 show general features of a dispenser suitable for a readily-flowable product such as a cream or gel.

The container 1 may be of e.g. LDPE and the pump 9 e.g. of polypropylene (PP); a particular feature of this embodiment is that the pump is made entirely of PP.

Figure 2:
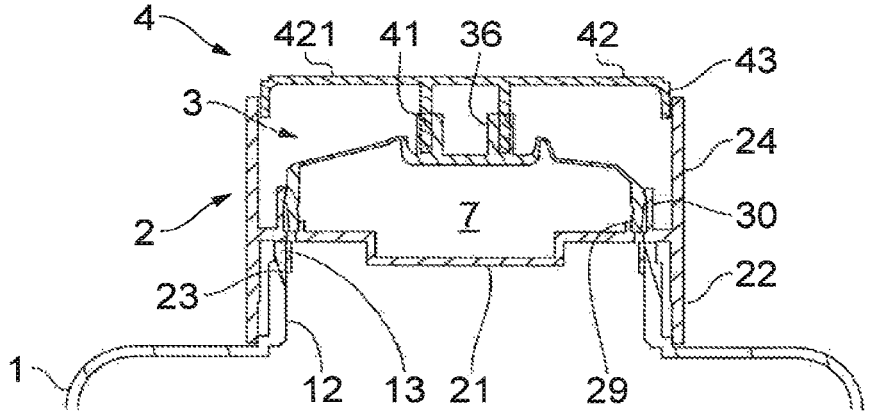
FIG. 2 is a vertical diametral section through the pump of the dispenser.
Figure 3:
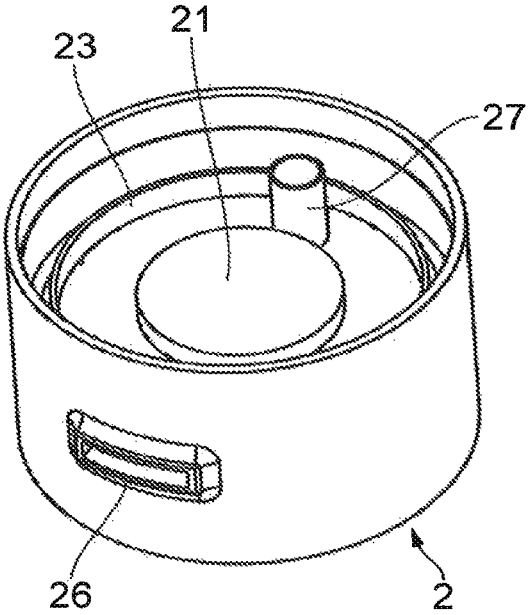
FIG. 3 is a bottom perspective view of a closure body of the dispenser shown separately.
Figure 4:
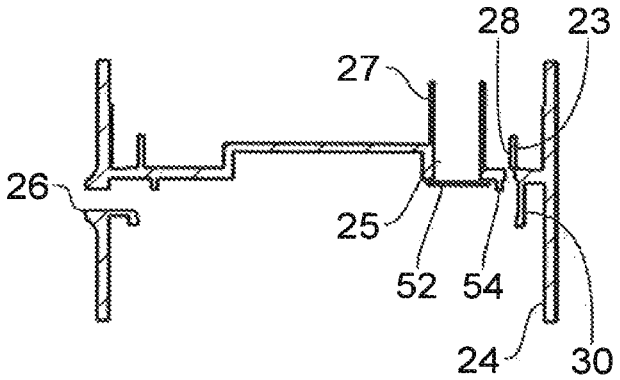
FIGS. 4, 5 and 6 are respectively a vertical diametral cross-section, a perspective top view and a plan view of the closure body.
Figure 5:
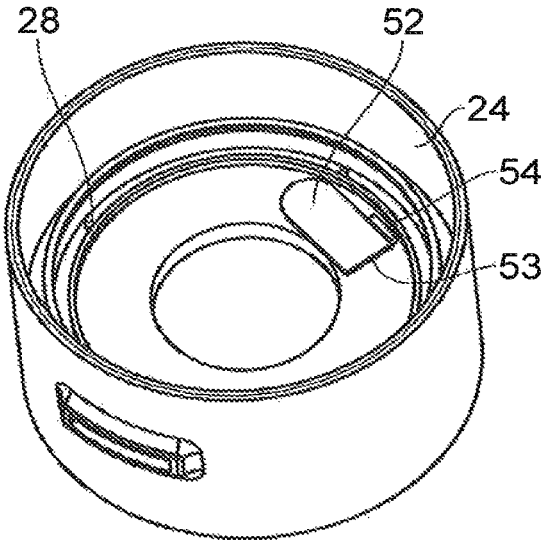
Figure 6:
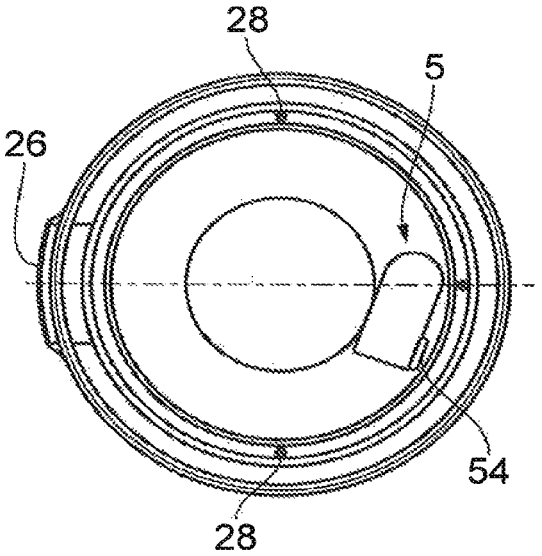
Figure 7:
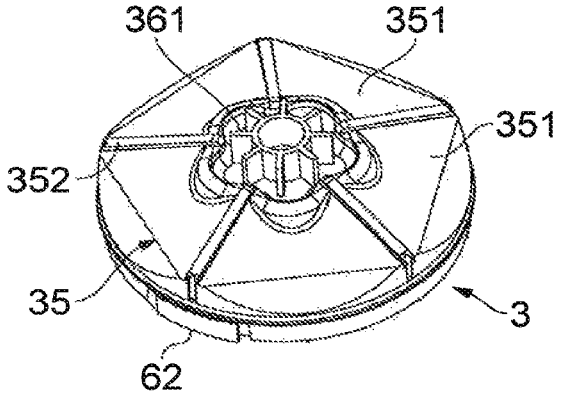
FIGS. 7 and 8 are respectively top and bottom perspective views of a diaphragm body component of the pump shown separately.
Figure 8:
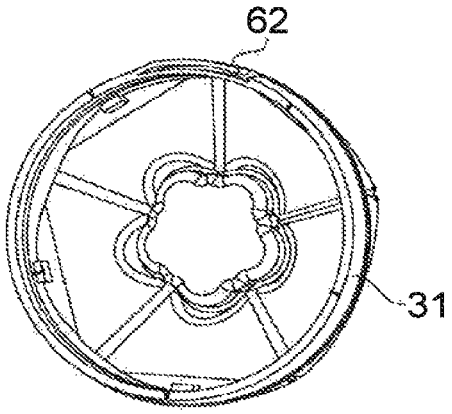

Referring also to FIG. 2, the pump 9 consists essentially of three moulded components, namely a closure body 2, a diaphragm body 3 which forms a pump chamber with the closure body and an actuator 4 for controlled pressing of the diaphragm body 4.

Figure 18:
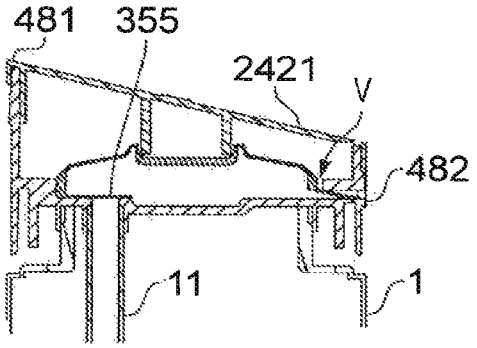
FIG. 18 is a vertical diametral cross-section of the FIG. 17 pump.
Figure 19:
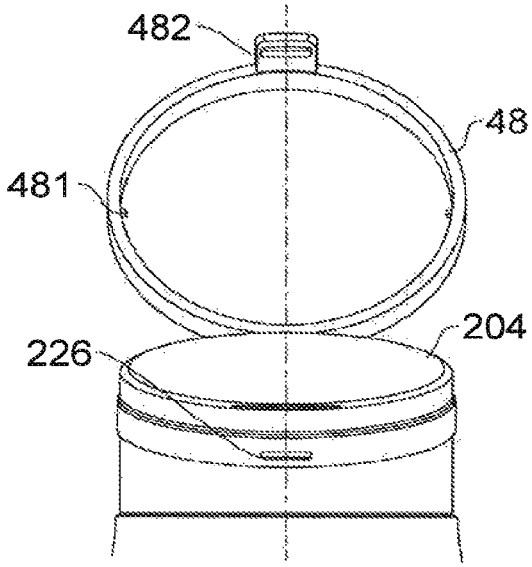
FIG. 19 is a front view showing the tamper-evident ring lifted clear.
Figure 20:
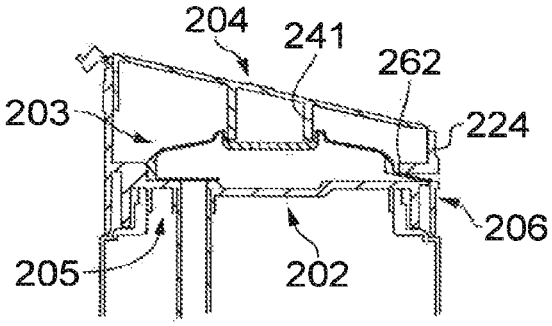
FIG. 20 is a corresponding cross-section.
Figure 21:
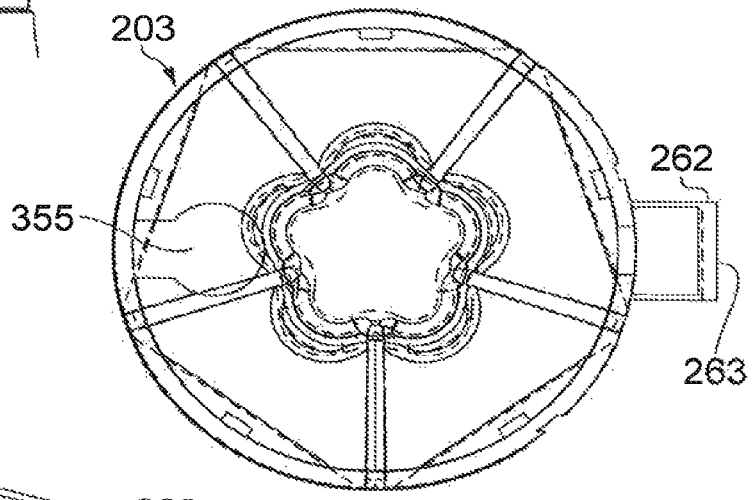
FIG. 21 is an underneath view of the diaphragm body of the second embodiment.
Figure 22:
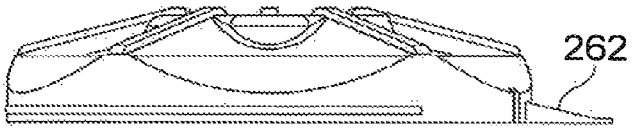
FIG. 22 is a side view of the diaphragm body.
Figure 23:
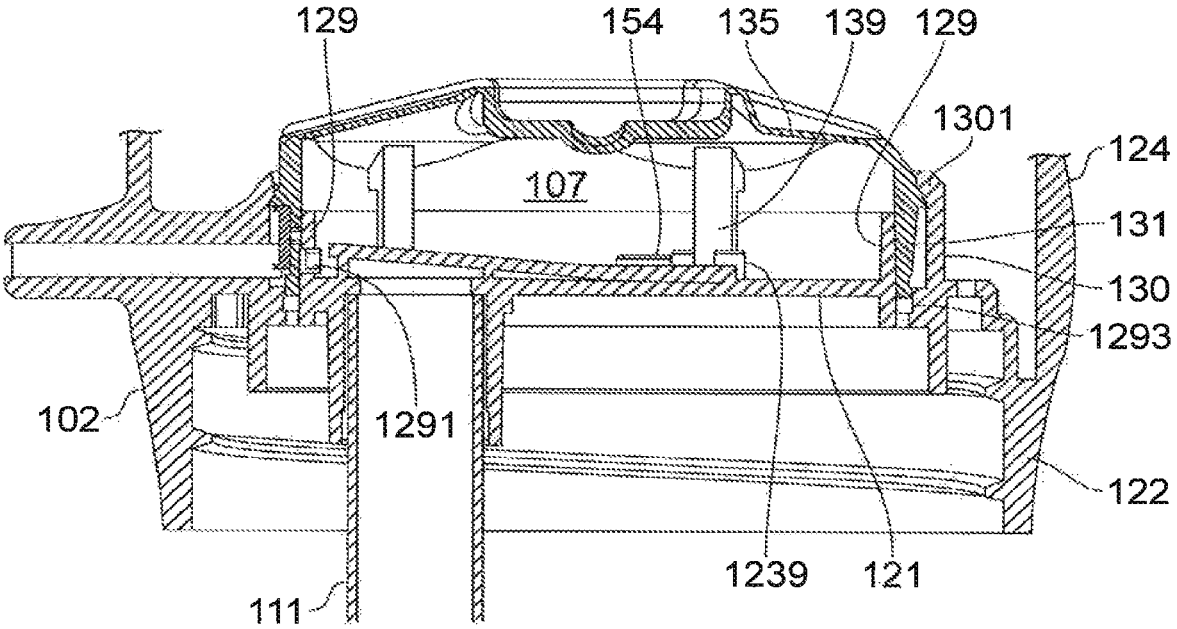
FIG. 23 is a vertical diametral cross-section of a third embodiment of dispenser pump, omitting the actuator.
Figure 24:
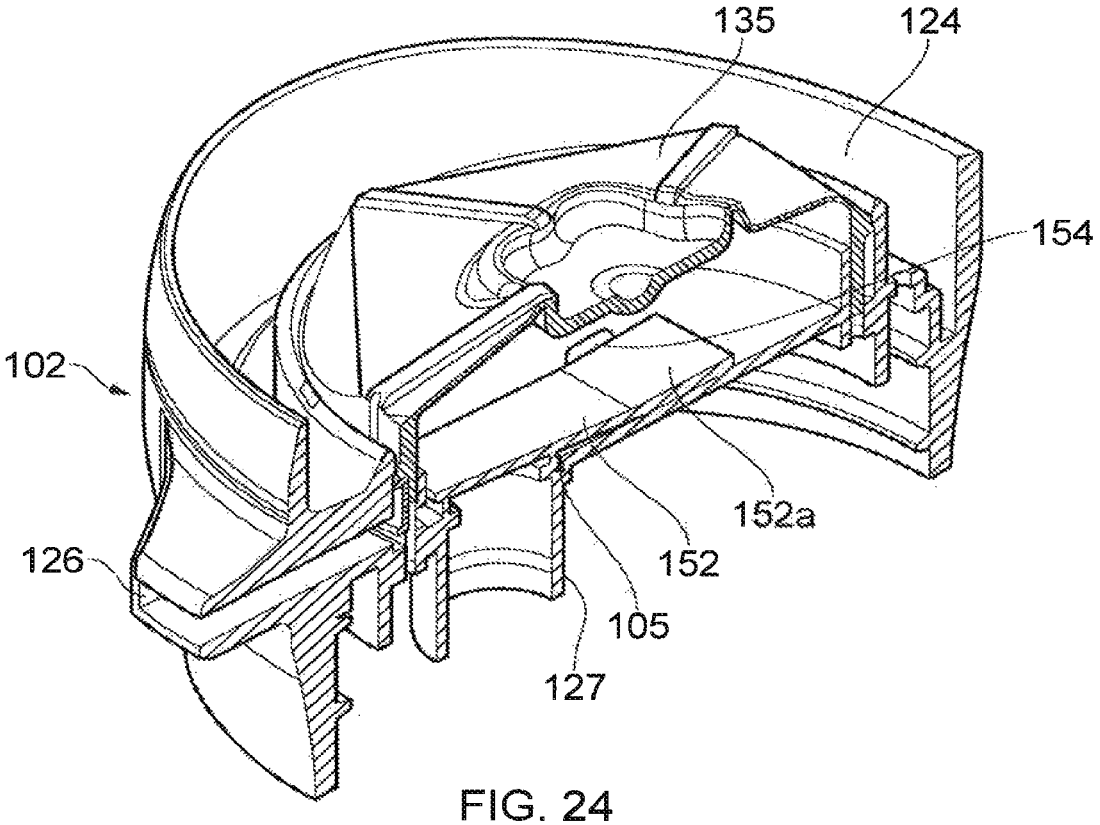
FIG. 24 is a top oblique view of the same components as FIG. 23.
Figure 26:
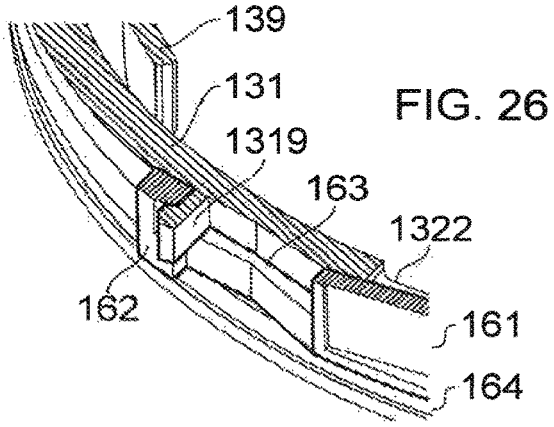
FIG. 26 is a fragmentary radial cross-section at the periphery of the diaphragm body showing the valve element in position, bisected at half-height.

With reference also to FIGS. 3 to 6, the closure body 2 has a generally cylindrical outer wall providing a downward covering skirt 22 and downward retaining formations 23 (e.g. snap, push or thread) for engaging the container neck 12. The neck 12 has corresponding retaining formations 13. The closure body outer wall extends up as an upwardly-projecting cylindrical guide portion or sleeve 24 in which the actuator 4 can move as described later. A closure plate or floor 21 spans the middle of the closure body, held down against the container neck 12 to close it off except for inlet and vent openings to be described later. The body floor 21 is horizontal with a central lower or depressed area and a peripheral flat area. An annular retaining structure consisting of inner and outer upwardly-projecting retaining rings 29,30, for retaining the diaphragm body 3, extends around the peripheral region of the floor plate 21. At a front part, an outlet opening 26 opens through the side wall of the closure body just above the level of the floor 21, and extends back as a passage through a gap or gate of the retaining ring structure 30 described in more detail later. Diametrically opposite the inlet opening 26 an inlet opening 25 passes through the flat peripheral area of the floor 21 and has an integrally-moulded downwardly-projecting dip tube socket 27. [The dip tube is not shown, but can be the same as the dip tube 11 shown in FIG. 18 for the second embodiment described below.]

Just to the (radial) inside of the annular retaining formations 29,30 three small vent holes 28 penetrate the floor plate 21 and these are to allow compensation air into the container as described later.

An inlet valve 5 is formed integrally with the floor plate 21, and includes a valve flap 52 and a retaining post 54. The flap 52 is hinged integrally to the plate 21 along a hinge line 53 next to the inlet opening 25, and as moulded projects vertically (axially) up from the plate 21. The retaining post 54 has a slight overhang (to the extent compatible with mould separation) relative to the swing path of the flap 52. On assembly, the flap 52 is pushed down past the top overhang of the retaining post 54 which subsequently holds it in the position shown, close to the inlet opening 25, so that it responds reliably to pressure in the pump chamber 7 by closing down against the plate 21 to shut the inlet.

Figure 15:
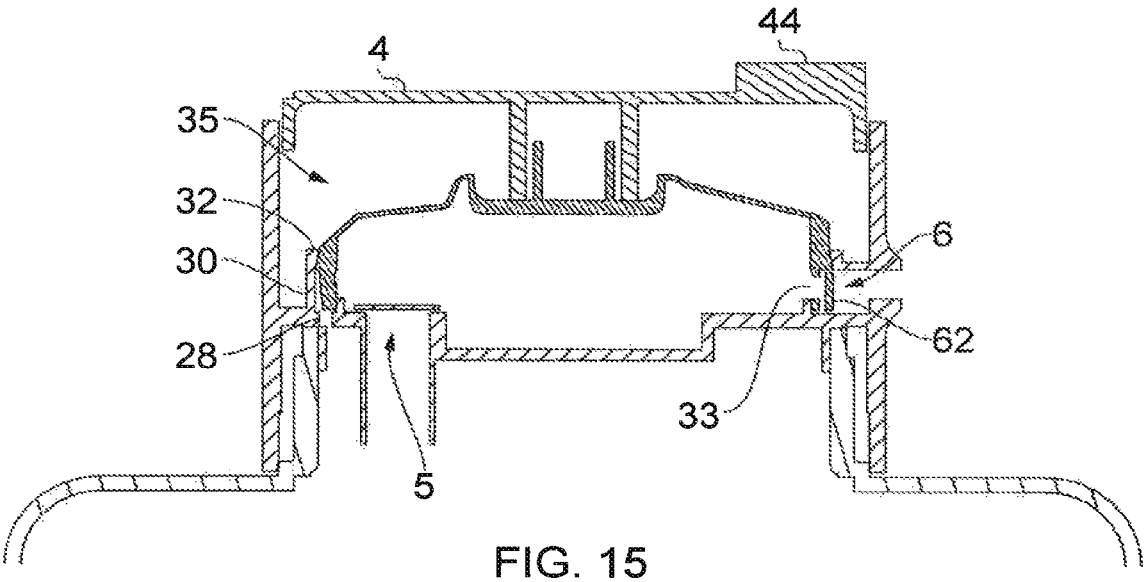
FIGS. 15 and 16 are vertical diametral cross-sections through the pump in the rest (extended) and the depressed conditions of the actuator, showing the cooperation of parts forming a vent.
Figure 16:
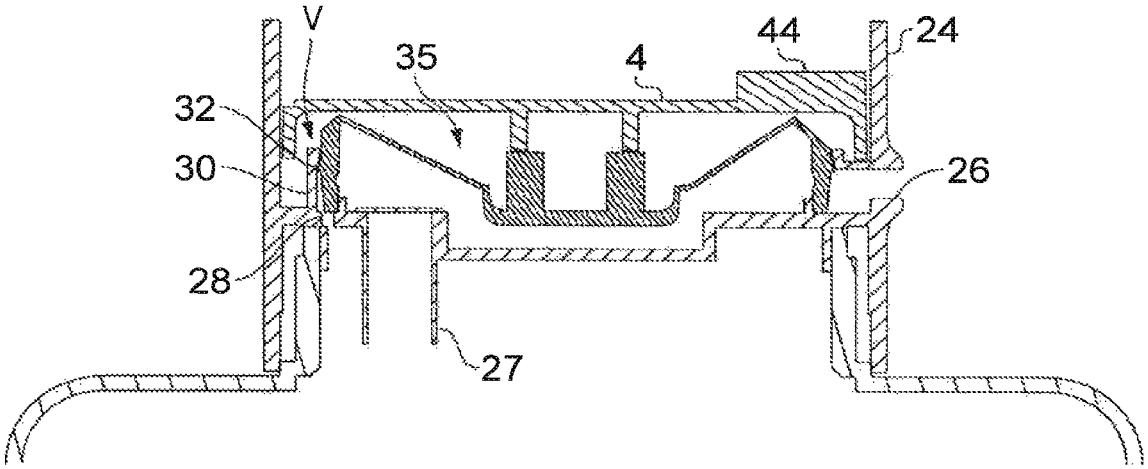
Figure 17:
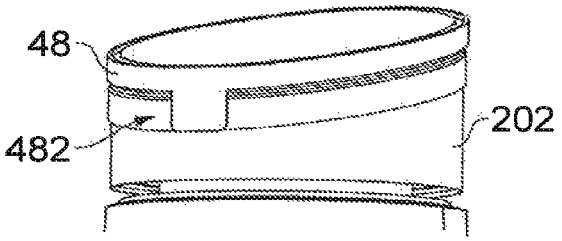
FIG. 17 is an external perspective view of a second embodiment of dispenser pump with a tamper-evident ring in place.

FIGS. 7 to 12 show in more detail the diaphragm body 3 which consists generally of an outer annular support portion 31, a central rigid hub or actuator connector 36 and a deformable wall 35 extending between them. It is a single moulding of polypropylene. The annular support or mounting portion 31 plugs in, with some snap retention, between the inner and outer retaining rings 29,30 of the closure body to define the pump chamber 7 between the floor plate 21 and the deformable wall 35. The outer retaining ring 30 is slightly turned in at the top for this retention. The deformable wall has a plurality—five in this version—of gently-inclined facets 351 forming a generally pyramidal shape around the hub 36. For each facet 351 the hub has a projecting cylindrical portion 353 which is downwardly angled, maintains its rigidity, and meets the facet 351 along a curved boundary so that, when the hub 36 is pushed down, the cylindrical formations 353 force heavy bending of the facet 351 along that boundary, creating a restoring force much greater than would arise from a general bending of the facets sufficient to accommodate the same distance of deformation. FIGS. 15 and 16 show the deformable wall 35 in its extended and depressed conditions respectively. Thicker radial ridges 352 extend between the facets 351. The hub 36 has radial fins 361 providing a rotational lock to the actuator 4 above.

Figure 1:
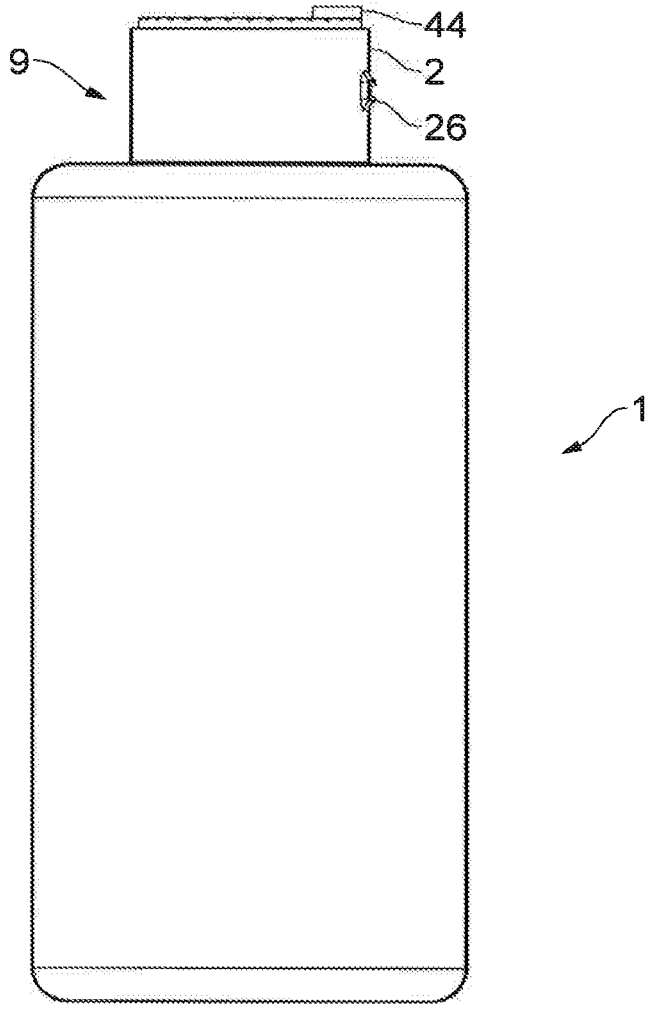
FIG. 1 is a side view of a first embodiment of dispenser.

The actuator 4 is a simple cover and push button comprising a top plate 42 providing a push surface 421 and whose edge 43 fits into the cylindrical upper guide 24 of the closure body to cover the diaphragm and guide the dispensing movement along the pump axis. The connector socket 41 beneath the top plate connects to the hub 36 of the diaphragm body 3 with rotational locking. A turning tab 44 projects up from the top of the actuator near the edge: see FIGS. 1 and 15. The actuator again is a one-piece moulding of polypropylene.

The annular support 31 of the diaphragm body 3 has a number of structural features of functional importance in its interaction with the corresponding support structure 29,30, vent structure 28 and outlet 26 of the closure body 2 and these are now described.

The support ring 31 is thicker than the deformable wall 35 to provide firm mounting and support, but its fit into the annular channel between the body rings 29,30, while retained by some "snap" behind the top inward projection of the wall 30, also has some clearance. Thus, a projecting lip 32 extends around the top of the retaining ring 31 (see FIG. 15) and, in the rest position, forms a seal around the top of the retaining ring 30. Below this annular seal engagement the support ring 31 reduces in thickness and fits less tightly in the channel between the body rings 29,30. At the bottom of this channel the vent holes 28 penetrate the closure plate 21 (FIGS. 15, 16). When the actuator 4 is depressed in a dispensing stroke, as shown in FIG. 16, its hub 36 descends substantially beneath the periphery of the deformable wall 35, pulling in the top of the support ring 31 and tilting it slightly away from the outer ring 30 of the closure body that surrounds it. This disengages or relaxes the seal 32 between the top parts of these components, allowing venting air to enter along the vent path V (FIG. 16) and reach the vent openings 28 leading into the container interior.

Figure 9:
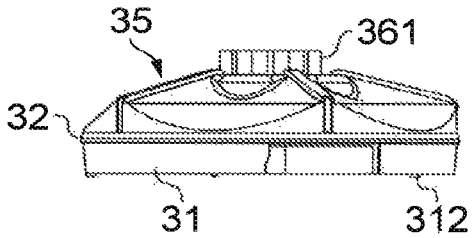
FIGS. 9, 10 and 11 are respectively a side view, a vertical diametral cross-section and a bottom view of the diaphragm body.
Figure 10:
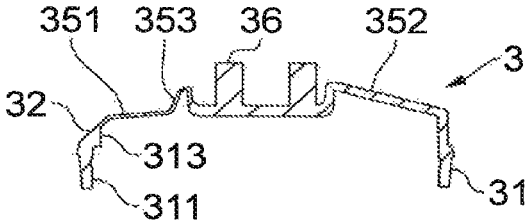
Figure 11:
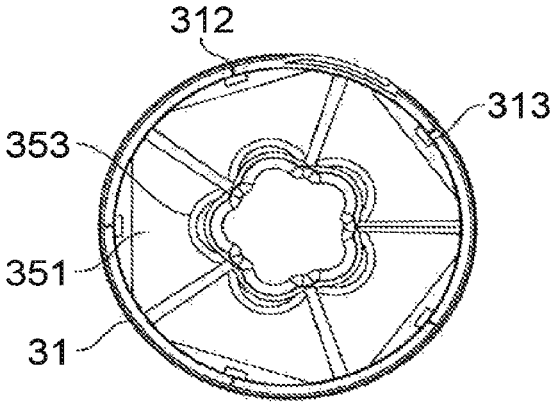
Figure 12:
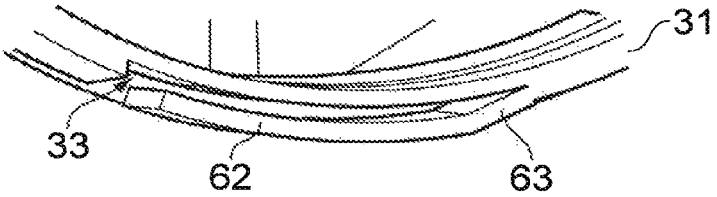
FIG. 12 is an enlarged bottom view showing an outlet valve region of the diaphragm body.

The support ring 31 also has downwardly-projecting nibs 312 and inwardly-projecting nibs 313 (FIGS. 9, 11). The nibs 312 locate it with slight clearance from the closure plate 21 to assure venting and also to reduce friction, so that the diaphragm body 3 can be rotated relative to the closure body 2 by turning actuator 4 using the tab 44. This is for locking/unlocking the outlet valve as described below.

Figure 13:
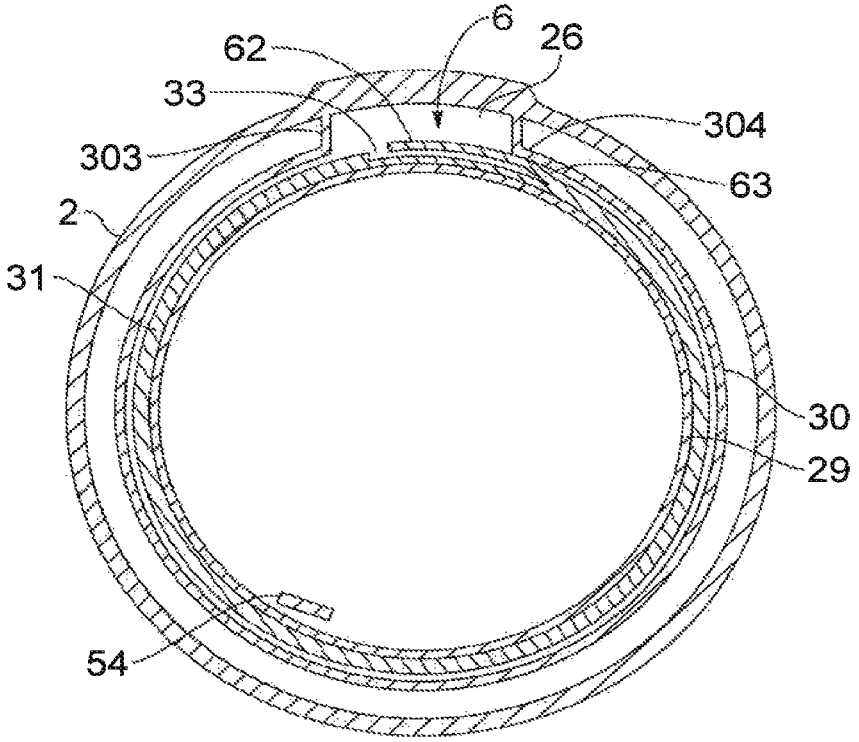
FIG. 13 is a horizontal cross-section through the assembled pump at the level of the outlet valve, showing an open condition.

The outlet valve, generally indicated 6, is now described with reference particularly to FIGS. 7 and 12 to 15. Adjacent the outlet opening 26 the outer retaining ring 30 is interrupted at a gate opening and has outward extensions 303 where it connects to the outer wall of the body 2 forming an outlet channel (see FIG. 13). In register with this, the diaphragm body's support ring 31 has a corresponding gate opening 33 which can be covered by a valve flap 62. The flap 62 projects circumferentially in cantilevered fashion from an outwardly-crooked link portion 63 as a continuation from the annular support 31: see FIG. 12 especially. FIG. 13 shows the unlocked or open condition, with the actuator 4 rotated so that the outlet valve flap 62 and the gate opening 33 behind it lie in line with the outlet passage/opening 26. Pressure increase in the pump chamber 7 on depression of the deformable wall 35 causes the flap 62 to flex outwardly, allowing product to flow out through the outlet 26. When the actuator is released to rise under the resilient restoring force of the deformable wall 35, the negative pressure draws the valve flap 62 back against its seat over the gate 33 so that the pump chamber re-fills through the inlet valve 5. In this embodiment the valve flap 62 sits against the support portion 31 of the same component, but the skilled person will realise that, depending on the configuration of the outlet, it might seat against the part of the closure component, or against or between both.

Figure 14:
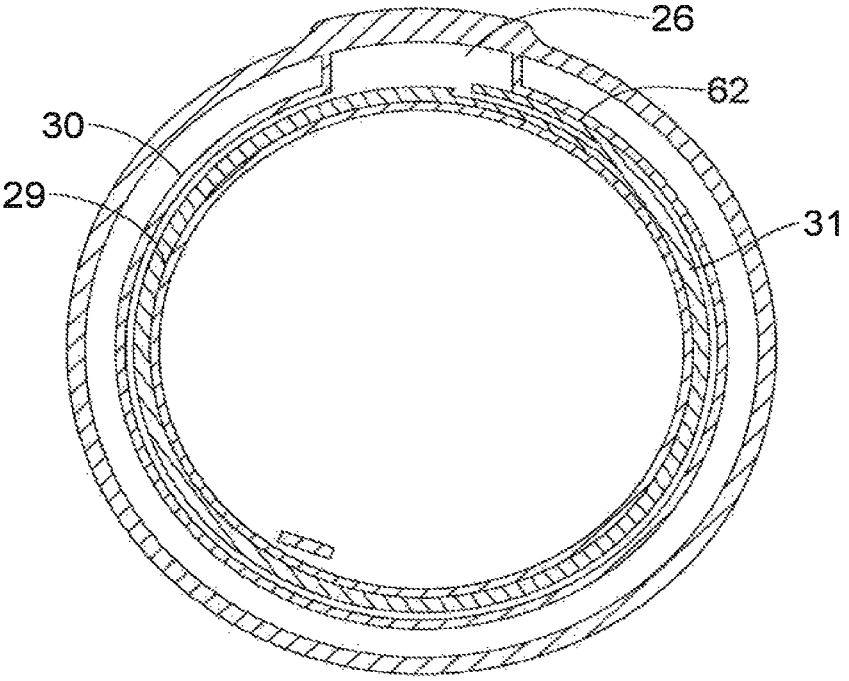
FIG. 14 is a corresponding view showing the closed condition of the outlet valve.

By turning the actuator 4 the diaphragm body 3 can be rotated relative to the closure body 2 to the position shown in FIG. 14, where the valve flap 62 has slid along behind the retaining wall 30 to a position where it can no longer flex outwardly. In this position the pump is locked and cannot dispense; both inward and outward leakage are prevented.

FIGS. 17 to 22 show a variant embodiment. Instead of a lockable outlet valve, here a tamper evident ring 48 is provided, initially joined to the actuator button 204 through a set of thin frangible links 481 and engaging around the outside of the top of the closure body 224 so that the actuator 204 cannot be depressed until the ring 48 has been pulled clear. The ring 48 also carries a plug tab 482 at its front edge which can be plugged into the outlet opening 226 to prevent leakage. In this embodiment the actuator button 204 has an angled top plate surface 2421 for styling reasons, but can still operate the diaphragm 203 as before. The structures of the inlet valve 205 and outlet valve 206 are different, however. For the inlet valve 205, the inlet opening and dip tube arrangement are similar to the first embodiment. However, the valve flap 355 is formed as an integral part of the diaphragm body 203, moulded in one piece with it and then folded underneath on assembly to overlie the inlet opening. Thus, no additional component is involved.

Accordingly, the diaphragm body 203 and closure body 202 are not relatively rotatable. Here, the outlet valve has a flap 262 of a "duck bill" form that projects radially outwardly from the edge of the diaphragm support ring into the outlet channel 226, where its tip extremity 263 can seal against the bottom surface of the outlet channel. As in the first embodiment, therefore, this embodiment provides a complete pump arrangement in only 3 components, all of which can be moulded from polypropylene.

A third embodiment is shown in FIGS. 23 to 28. It includes a closure body 102 and diaphragm body 103, of the same general nature as in the first embodiment, defining a pump chamber 107. A top actuator is also included, operating within the outer guide 124 of the closure body, but is not shown here.

Here the closure body 102 has the inlet valve 105, dip tube socket 127 and dip tube 111 at the front and in line with the outlet 126, and the inlet valve is generally central in the floor 121 of the closure plate. As in the first embodiment, the flap 152 of the inlet valve is integrally moulded with the closure floor 121, initially as a perpendicular upper projection from it (for withdrawal from the mould). On assembly of the components, the flap 152 is folded from the root down to the position shown, and the part near the root snapped down between a pair of opposed snap posts 154 so that this region 152*a* (see FIG. 24) is held down against the floor 121 while the main part of the flap can swing. A feature here is that the inlet opening has a slight tubular extension 1215 around it, above the floor 121, with an inclined planar edge providing a seat against which the flap 152 can lie flat at a slight inclination from the floor 121. By appropriate dimensioning of the snap formations on the retaining posts 154, this holds the valve flap 152 closed with pre-load against its seat, without a spring being needed. The flap 152 opens and closes in the direction indicated by arrow "A" in FIG. 27.

Figure 25:
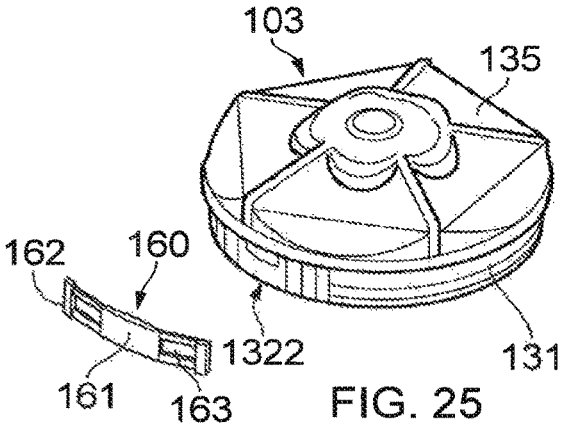
FIG. 25 shows the diaphragm body and outlet valve element of the third embodiment.
Figure 28:
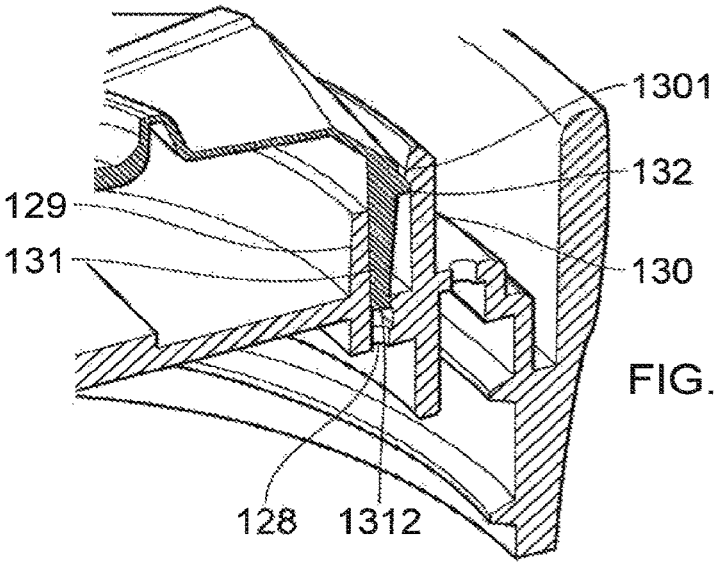
FIG. 28 is a corresponding enlarged cross-section but at a position opposite the outlet.
Figure 27:
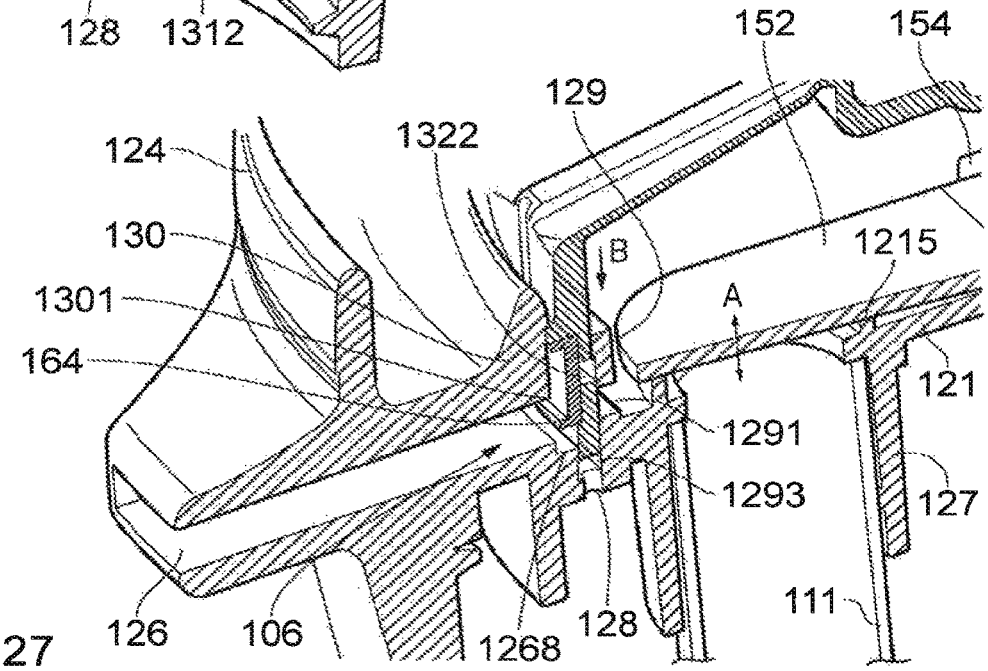
FIG. 27 is an enlarged fragmentary cross-section showing the outlet portion of the third embodiment.

The diaphragm component 103—shown separately in FIG. 25—has the same general elements as in the first embodiment with a deformable wall 135, already described, and a peripheral annular support portion 131. The annular support 131 plugs into the channel 1293 between the inner and outer retaining rings 129,130 of the closure body.

Unlike the first embodiment, the diaphragm component 103 is not rotatable in its mounting. Indeed, it has a circumferentially-spaced set of internal spring legs 139 engaging in slots 1239 of the closure plate floor (see FIG. 23) to prevent rotation. However it is movable axially (up and down) in the mounting channel, so that its outer annular bottom edge 1312 (FIG. 28) is either off the bottom of the channel in the up position (shown) or, in the down position, pressed against the bottom of the channel and at the same time blocking of the vent openings 128. The spring legs 139 bias it towards the up position. A top inward lip 1301 of the outer retaining ring (FIG. 28) holds it down in place.

A further difference in this embodiment is the mechanism of the outlet valve, generally indicated at 106. The outlet valve member 160 is a separately-moulded (polypropylene) component for ease of moulding the diaphragm component 103, although the mechanism described below can also be used with an integrated valve flap (as indeed the mechanism of the first embodiment can be used with a discrete valve member). Still, the polymer can be the same. The outlet valve member 160 comprises a closure flap 161 with, to either side, a retaining piece 162 which clips to the diaphragm annular support 131 at a clip 1319 thereof and a crooked flexible link 163. The flap 161 overlies a sliding gate opening 1322 through the diaphragm's annular support 131. Obviously other mountings or fixings of a flap or other blocking member, optionally with integral formation, might be used. The inner and outer retaining rings 129,130 (FIG. 27) have aligned inner and outer outlet openings 1291,1301, the latter leading through to the external outlet 126 of the closure body. The outlet valve flap 161 lies in an external recess of the annular support 131 so that it is carried up and down with it between the mentioned up and down positions. In the up position of FIGS. 23 and 27 the top of the flap 161 engages inside the outer retaining ring 130 so that the flap cannot lift off the gate opening 1322. Also, the gate opening 1322 is out of line with the fixed inner and outer outlet openings 1291,1301 so that the outlet path is securely blocked and closed. This is the normal rest position, with the actuator up.

When the actuator is depressed with the pump chamber full of product, the diaphragm component 103 is pushed down, with both indenting deformation of its diaphragm wall 135 and bodily downward sliding of its annular mounting portion 131 in the fixed channel 1293, against the return force of the spring legs 139. See arrow "B" in FIG. 27. This slides the gate opening 1322 down into line with the inner and outer outlet openings 1291,1301 so that forward fluid pressure pushes the valve flap outwardly—with extension of the valve member links 163—and product is dispensed from the pump chamber through the three aligned openings and the outlet nozzle 126.

The up and down (axial) movement of the annular mounting portion 131 not only operates the outlet valve release but also actuates the venting of the pump. As mentioned, the vent openings 128 to the container interior are at the bottom of the channel 1293. When the actuator is initially released, the bottom edge 1312 of the mounting ring 131 comes clear of the vent holes 128 (FIG. 28) and a bottom abutment 164 of the valve flap 161 comes clear of an abutment shelf 1268 along the bottom of the outlet path (FIG. 27), opening up a path for venting air around the bottom of the ring 131 and into the container, while the sliding gate action quickly seals the pump chamber outlet to drive refilling of the pump chamber through the inlet valve 105.

The skilled reader will understand that the concepts put forward herein can be applied over a range of different designs and dispenser types. The distinctive vent design may be used in any kind of pump using a deformable walled component. The distinctive integrated inlet valve features described herein may be used in a wide variety of pumps with moulded components. The same is true for the outlet valve concepts which may be used in a variety of pumps with relatively rotatable components. Similarly, the adaptations put forward herein for the diaphragm body may be used in other pumps of the general kind described, without necessarily incorporating other characterising features disclosed herein.

The invention claimed is:

1. A resilient diaphragm body for use as a spring in a dispensing pump, the body comprising:

an annular outer support wall having one or more mounting portions along a lower edge thereof;

a centralized hub;

a plurality of deformable wall panels spaced apart around a top edge of the annular support wall, each deformable wall panel having an inclined facet attached to the hub by a projecting cylindrical formation that is rigid and angled to induce bending along a boundary of each inclined facet and the cylindrical formation associated therewith;

wherein the plurality of deformable wall panels form a pyramidal shape around the centralized hub;

wherein each deformable wall panel is separated along a top facing of the body by a radial ridge running from the hub to the outer support wall and wherein each radial ridge has a greater thickness than the inclined facets immediately adjacent the radial ridge;

wherein, upon application of axial downward force applied to the centralized hub causing displacement of each deformable wall panel, a bottom edge of the centralized hub descends to the lower edge of the annular outer support wall so as to temporarily flatten each projecting cylindrical portion;

wherein, upon release of the axial downward force, each projecting cylindrical portion creates an upward restoring force urging the deformable wall panels back to an original position; and wherein the lower edge of the annular outer support wall includes downwardly-projecting nibs providing a slight clearance for venting.

2. The diaphragm body of claim 1 wherein the centralized hub includes at least one radial locking fin.

3. The diaphragm body of claim 1 wherein five deformable wall panels are provided.

4. The diaphragm body of claim 1 wherein a portion of the annular outer support wall includes a gate opening.

5. The diaphragm body of claim 4 wherein a valve flap covers the gate opening.

6. The diaphragm body of claim 5 wherein the valve flap cantilevers away from the annular outer support wall.

7. The diaphragm body of claim 1 wherein the lower edge of the annular outer support wall is thicker than the deformable wall panels, and is configured to deform from an original shape when the deformable wall panels are displaced.

* * * * *